US011105063B2

(12) United States Patent
Sato et al.

(10) Patent No.: US 11,105,063 B2
(45) Date of Patent: Aug. 31, 2021

(54) QUICK COUPLER CIRCUIT AND QUICK COUPLER ATTACHMENT/DETACHMENT METHOD

(71) Applicant: KOMATSU LTD., Tokyo (JP)

(72) Inventors: Koji Sato, Tokyo (JP); Takahide Takiguchi, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 16/471,337

(22) PCT Filed: Feb. 28, 2017

(86) PCT No.: PCT/JP2017/007663
§ 371 (c)(1),
(2) Date: Jun. 19, 2019

(87) PCT Pub. No.: WO2018/158797
PCT Pub. Date: Sep. 7, 2018

(65) Prior Publication Data

US 2019/0330819 A1 Oct. 31, 2019

(51) Int. Cl.
*E02F 3/36* (2006.01)
*E02F 9/22* (2006.01)
(Continued)

(52) U.S. Cl.
CPC ..... *E02F 3/3663* (2013.01); *E02F 9/2271* (2013.01); *E02F 9/2292* (2013.01);
(Continued)

(58) Field of Classification Search
CPC ..... E02F 3/3663; E02F 9/2271; E02F 9/2292; E02F 9/2296; E02F 9/2228; E02F 3/365;
(Continued)

(56) References Cited

U.S. PATENT DOCUMENTS 5,147,173 A * 9/1992 Fauber ..... E02F 3/3627 172/273
6,260,357 B1 * 7/2001 Goodfellow ..... B66F 9/0655 60/470
(Continued)

FOREIGN PATENT DOCUMENTS

CN 103154383 A 6/2013
CN 105229239 A 1/2016
(Continued)

OTHER PUBLICATIONS

The International Search Report for the corresponding international application No. PCT/JP2017/007663, dated May 9, 2017.
(Continued)

*Primary Examiner* — Dustin T Nguyen
(74) *Attorney, Agent, or Firm* — Global IP Counselors, LLP

(57) ABSTRACT

A quick coupler circuit for attaching and detaching an attachment to a quick coupler includes a coupler cylinder, an actuator, a first hydraulic pump, a boosting valve, a coupler changeover valve, and a changeover switch. The boosting valve switches to a boosting position and the coupler changeover valve switches to a lock-side position when the changeover switch switches to a lock position. When the changeover switch switches to a hold position, the boosting valve switches to a non-boosting position and the coupler changeover valve switches to the lock-side position. When the changeover switch switches to an unlock position, the boosting valve switches to the boosting position and the coupler changeover valve switches to an unlock-side position.

4 Claims, 7 Drawing Sheets

(51) Int. Cl.
*F15B 11/17* (2006.01)
*F15B 13/02* (2006.01)

(52) U.S. Cl.
CPC ..... *E02F 9/2296* (2013.01); *F15B 11/17* (2013.01); *F15B 13/028* (2013.01); *F15B 2211/20538* (2013.01); *F15B 2211/20546* (2013.01); *F15B 2211/20576* (2013.01); *F15B 2211/56* (2013.01); *F15B 2211/7053* (2013.01); *F15B 2211/71* (2013.01)

(58) Field of Classification Search
CPC ..... E02F 3/36; E02F 3/40; F15B 11/17; F15B 13/028; F15B 2211/20538; F15B 2211/20546; F15B 2211/20576; F15B 2211/56; F15B 2211/7053; F15B 2211/71
See application file for complete search history.

(56) References Cited

U.S. PATENT DOCUMENTS 6,266,960 B1 * 7/2001 Bibb ..... E02F 3/3627 60/486
6,520,593 B2 * 2/2003 Dvorak ..... E02F 3/3414 299/39.5
7,367,256 B2 * 5/2008 Fatemi ..... E02F 3/365 91/1
7,426,796 B2 * 9/2008 Cunningham ..... E02F 3/3618 37/234
9,217,235 B2 * 12/2015 Robl ..... E02F 3/3618
9,228,314 B2 * 1/2016 Robl ..... E02F 3/3663
9,382,686 B2 * 7/2016 Friedrich ..... E02F 3/365
9,388,549 B2 * 7/2016 Friedrich ..... E02F 9/226
9,970,177 B2 * 5/2018 Koestler ..... E02F 3/3663
10,113,292 B2 * 10/2018 Yokota ..... E02F 3/3622
2007/0251755 A1 * 11/2007 Entwistle ..... B62D 5/091 180/417
2013/0160441 A1 6/2013 Yokohata et al.
2013/0177377 A1 7/2013 Van Hooft et al.
2013/0318841 A1 12/2013 Robl et al.
2014/0331663 A1 11/2014 Robl et al.
2017/0030047 A1 2/2017 Yokota et al.
2020/0217040 A1 * 7/2020 Hill ..... F16K 31/42

FOREIGN PATENT DOCUMENTS

CN 106133249 A 11/2016
JP 11-181819 A 7/1999
JP 2012-2034 A 1/2012
KR 10-0682308 B1 2/2007
WO 2015/102120 A1 7/2015

OTHER PUBLICATIONS

The extended European search report for the corresponding European application No. 17899109.7 dated Jun. 8, 2020.
The Office Action for the corresponding Chinese application No. 201780077700.2, dated Nov. 25, 2020.

* cited by examiner

QUICK COUPLER CIRCUIT AND QUICK COUPLER ATTACHMENT/DETACHMENT METHOD

CROSS-REFERENCE TO RELATED APPLICATIONS

This application is a U.S. National stage application of International Application No. PCT/JP2017/007663, filed on Feb. 28, 2017.

BACKGROUND

Field of the Invention

The present invention relates to a quick coupler circuit and a quick coupler attachment/detachment method.

Background Information

A construction machine is conventionally known that is provided with a quick coupler that is capable of attaching and detaching various attachments at the tip end of a work implement. The quick coupler has a quick coupler cylinder that locks and unlocks an attachment by extension and contraction due to the supply of hydraulic fluid.

Japanese Patent Laid-open No. 2012-2034 discloses a method for ending the supply of hydraulic fluid to the quick coupler cylinder after a predetermined time period has elapsed from the operation of a switch when the operator operates the switch for locking the attachment. According to this method, fuel consumption can be improved because the hydraulic pump is driven efficiently.

SUMMARY

However, in the method described in Japanese Patent Laid-open No. 2012-2034, because the hydraulic pump is not driven while the switch is not operated by the operator and hydraulic fluid is not supplemented to the quick coupler cylinder, the locked state of the attachment cannot be stabilized.

The present invention takes into account the above situation and an object of the present invention is to provide a quick coupler circuit and a quick coupler attachment/detachment method with which the locked state of the attachment can be stabilized.

A quick coupler circuit according to the present invention is for attaching an attachment to a quick coupler and for detaching the attachment from the quick coupler, and includes a coupler cylinder, an actuator, a first hydraulic pump, a boosting valve, a coupler changeover valve, and a changeover switch. The coupler cylinder is configured to be driven due to the supply of hydraulic fluid, in a locking direction to lock the attachment to the quick coupler and in an unlocking direction to unlock the attachment from the quick coupler. The actuator is configured to be driven due to the supply of hydraulic fluid. The first hydraulic pump is configured to be connected in parallel with the coupler cylinder and the actuator, and is configured to supply the hydraulic fluid to the coupler cylinder and the actuator. The boosting valve is configured to switch between a boosting position to raise a pressure of the hydraulic fluid supplied from the first hydraulic pump to the coupler cylinder, and a non-boosting position not to change the pressure of the hydraulic fluid supplied from the first hydraulic pump to the coupler cylinder. The coupler changeover valve is configured to switch between a lock-side position to supply hydraulic fluid from the first hydraulic pump to the coupler cylinder so as to drive the coupler cylinder in the locking direction, and an unlock-side position to supply the hydraulic fluid from the first hydraulic pump to the coupler cylinder so as to drive the coupler cylinder in the unlocking direction. The changeover switch is configured to switch between an unlock position, a lock position, and a hold position. When the changeover switch switches to the lock position, the boosting valve switches to the boosting position and the coupler changeover valve switches to the lock-side position. When the changeover switch switches to the hold position, the boosting valve switches to the non-boosting position and the coupler changeover valve switches to the lock-side position. When the changeover switch switches to the unlock position, the boosting valve switches to the boosting position and the coupler changeover valve switches to the unlock-side position.

According to the present invention, a quick coupler circuit and a quick coupler attachment/detachment method with which the locked state of the attachment can be stabilized can be provided.

DETAILED DESCRIPTION OF EMBODIMENT(S)

First Embodiment (Configuration of Wheel Loader 1)

Figure 1:
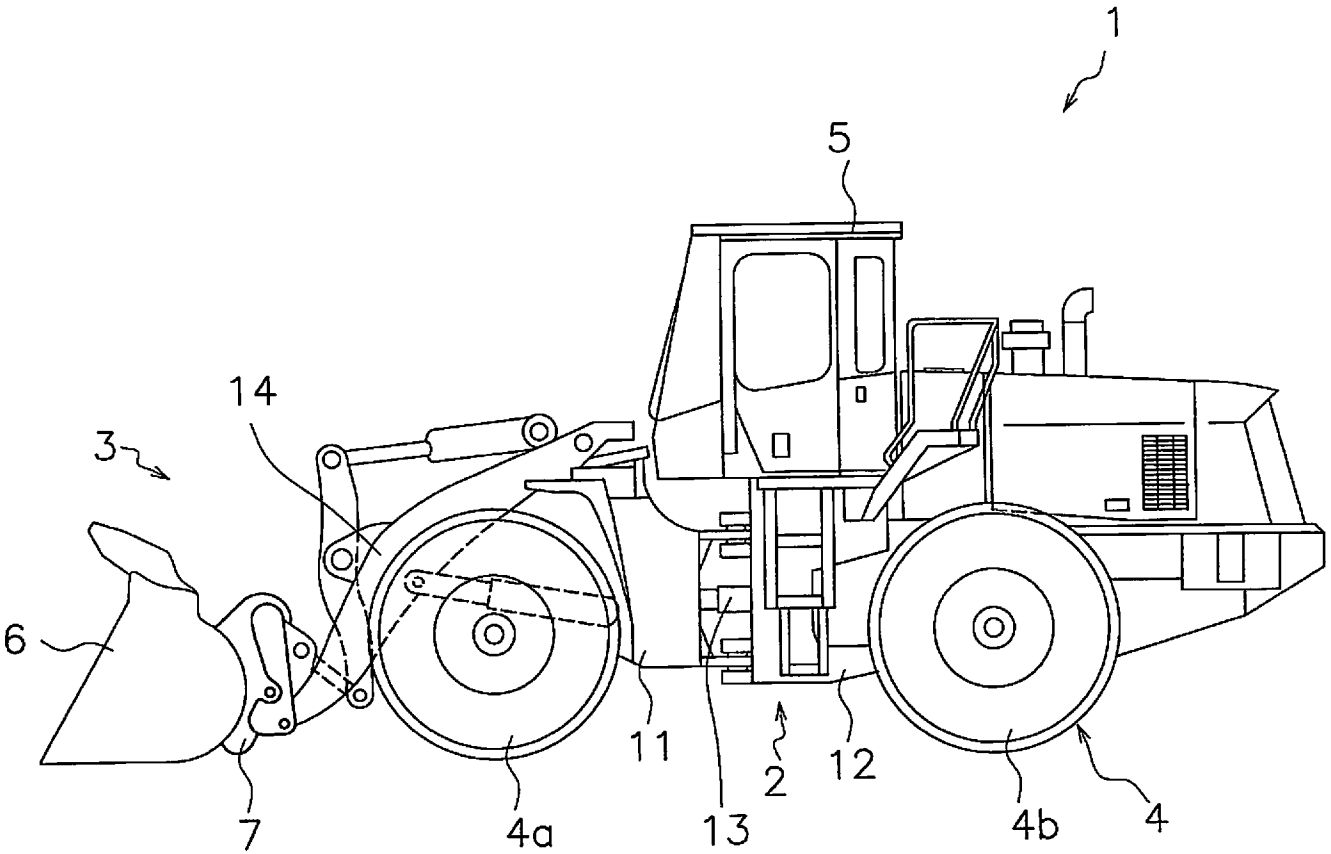
FIG. 1 is a side view of a wheel loader.

FIG. 1 is a side view of a wheel loader 1 according to an embodiment. The wheel loader 1 is provided with a vehicle body frame 2, a work implement 3, a travel device 4, and a cab 5.

The vehicle body frame 2 is configured from a front frame 11 and a rear frame 12. The work implement 3 is attached to the front frame 11. An engine (not illustrated) and the like are mounted on the rear frame 12.

The front frame 11 and the rear frame 12 are both able to pivot in the left-right direction. A steering cylinder 13 is attached to the front frame 11 and the rear frame 12. The steering cylinder 13 is a hydraulic cylinder that extends and contracts due to the supply of hydraulic fluid.

The work implement 3 is attached at the front of the front frame 11. The work implement 3 has a boom 14, a bucket 6, and a quick coupler 7. The boom 14 is rotatably attached to the front frame 11. The quick coupler 7 is attached to the tip end of the boom 14. The quick coupler 7 is configured so as to be able to attach and detach the bucket 6. The bucket 6 is an example of an "attachment" that can be attached to and detached from the quick coupler 7. A quick coupler circuit 20 for attaching and detaching the bucket 6 to and from the quick coupler 7 is explained below.

The travel device 4 has front traveling wheels 4*a* and rear traveling wheels 4*b*. The wheel loader 1 is able to propel itself by driving and rotating the front traveling wheels 4*a* and the rear traveling wheels 4*b*. The cab 5 is mounted on the vehicle body frame 2. The cab 5 is disposed to the rear of the boom 14. A seat for the operator to sit on and a belowmentioned operating device are disposed in the cab 5.

(Quick Coupler Circuit 20)

Figure 2:
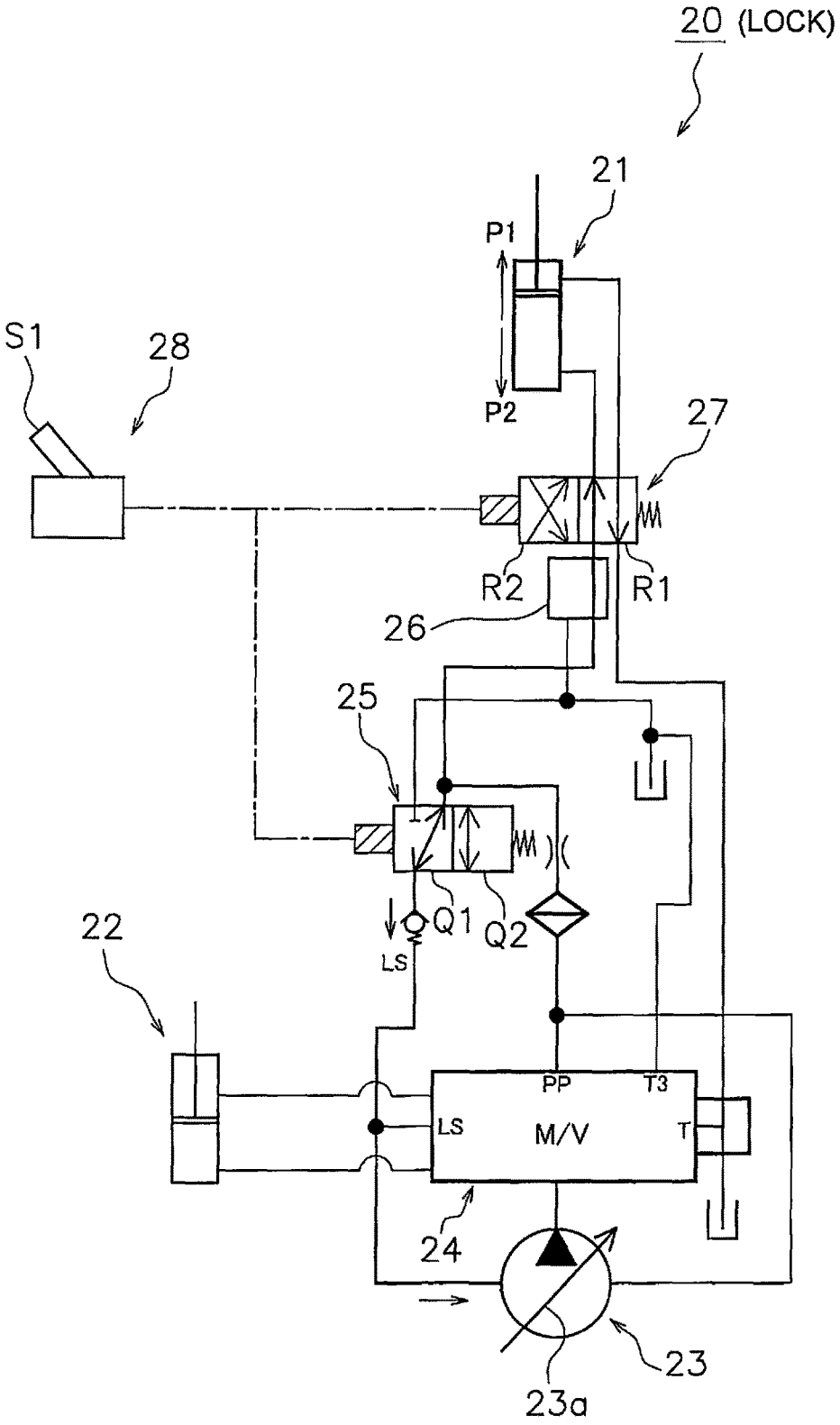
FIG. 2 is a schematic view of a quick coupler circuit (lock) according to a first embodiment.
Figure 3:
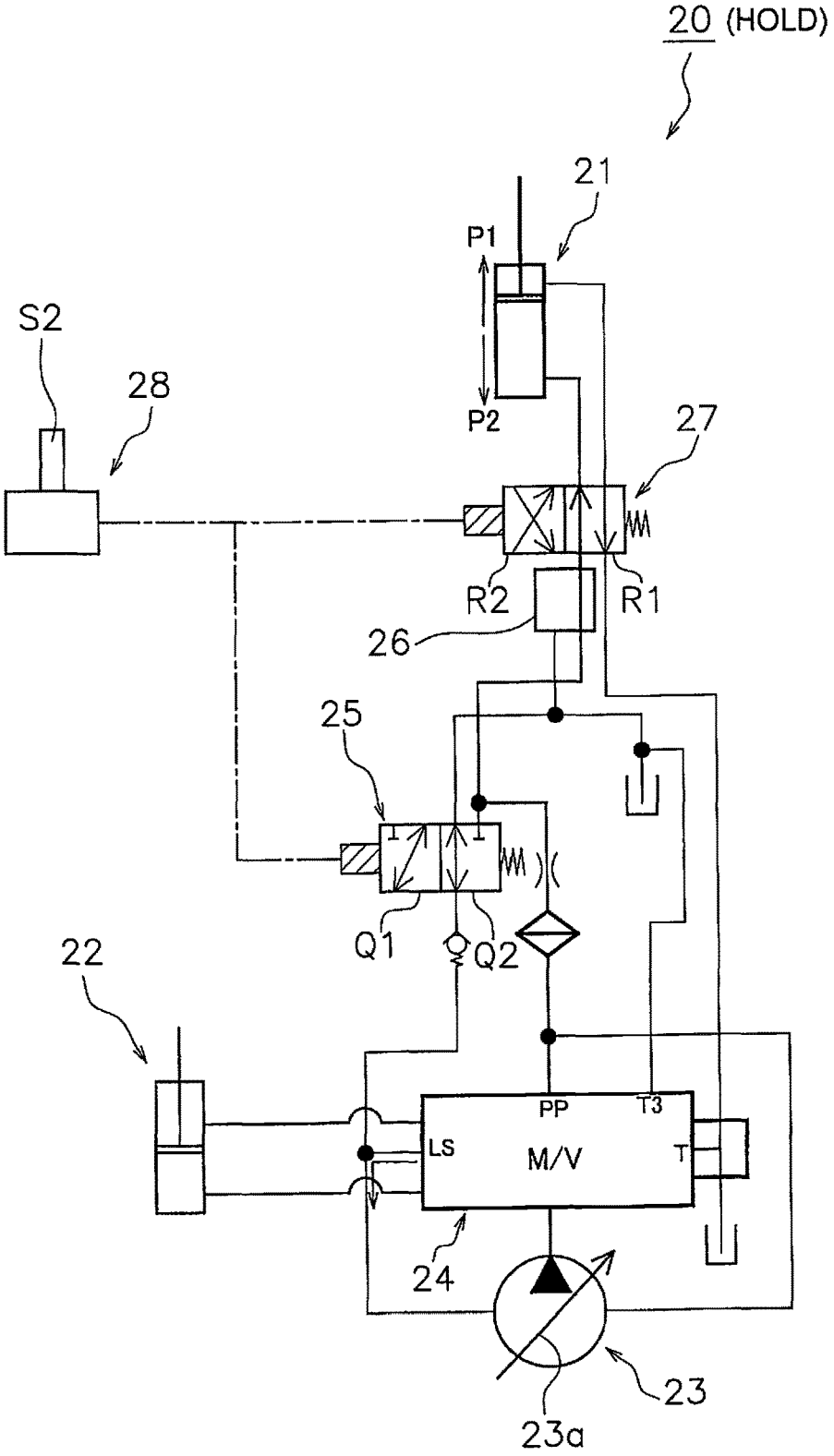
FIG. 3 is a schematic view of the quick coupler circuit (hold) according to the first embodiment.
Figure 4:
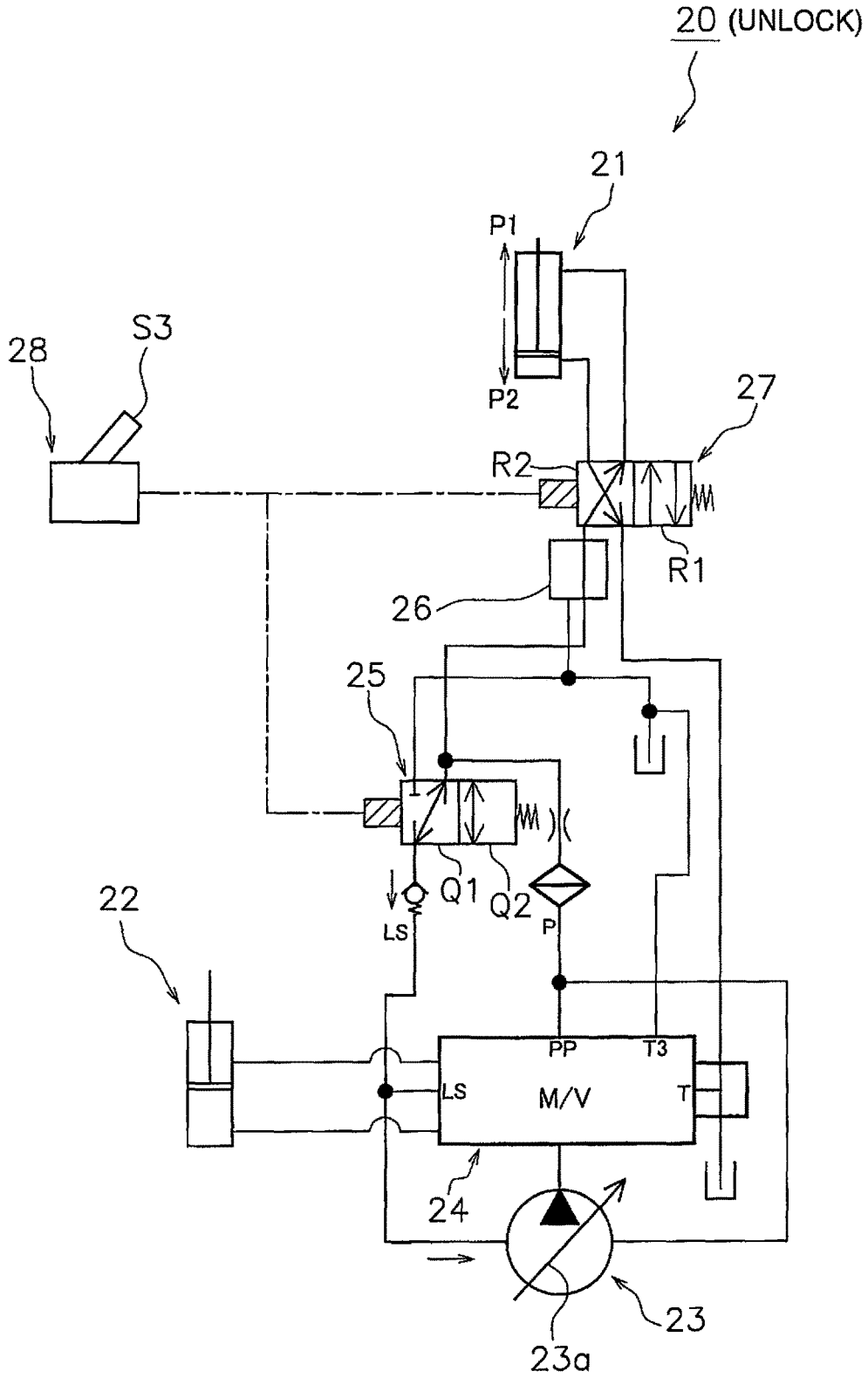
FIG. 4 is a schematic view of the quick coupler circuit (unlock) according to the first embodiment.

FIGS. 2-4 are schematic views of the quick coupler circuit 20 for attaching and detaching the bucket 6 to and from the quick coupler 7. FIG. 2 depicts a locking step for locking (securing) the bucket 6 to the quick coupler 7. FIG. 3 depicts a holding step for holding (retaining) the bucket 6 with the quick coupler 7. FIG. 4 depicts an unlocking step for unlocking (releasing) the bucket 6 from the quick coupler 7.

As illustrated in FIGS. 2-4, the quick coupler circuit 20 is provided with a coupler cylinder 21, a work implement cylinder 22, a main pump 23, a main valve 24, a boosting valve 25, a pressure reducing valve 26, a coupler changeover valve 27, and a changeover switch 28.

The coupler cylinder 21 is built into the quick coupler 7. The coupler cylinder 21 extends and contracts due to the supply of hydraulic fluid. The coupler cylinder 21 is driven in a locking direction P1 for locking the bucket 6 to the quick coupler 7, and an unlocking direction P2 for unlocking the bucket 6 from the quick coupler 7. In the present embodiment, the present invention is configured such that the bucket 6 is locked when the coupler cylinder 21 extends, and the bucket 6 is unlocked when the coupler cylinder 21 contracts. However, the present may be configured such that the bucket 6 is locked when the coupler cylinder 21 contracts, and the bucket 6 is unlocked when the coupler cylinder 21 extends.

The work implement cylinder 22 is a hydraulic cylinder for driving the work implement 3 (the boom 14 and the bucket 6). The work implement cylinder 22 is an example of an "actuator" that extends and contracts due to the supply of hydraulic fluid.

The main pump 23 is driven by an engine (not illustrated). The main pump 23 is an example of a "first hydraulic pump" for supplying hydraulic fluid to the coupler cylinder 21 and to the work implement cylinder 22. The coupler cylinder 21 and the work implement cylinder 22 are connected in parallel with the main pump 23. In the present embodiment, the main pump 23 is a variable capacitor pump. The volume of the hydraulic fluid supplied by the main pump 23 can be adjusted by changing the inclination angle of a skew plate 23*a*. The inclination angle of the skew plate 23*a* is changed by a volume control valve (not illustrated).

The main valve 24 is connected to the main pump 23 via hydraulic piping. The main valve 24 feeds hydraulic fluid supplied by the main pump 23 to each of the coupler cylinder 21 and the work implement cylinder 22. A coupler cylinder-side discharge port for feeding the hydraulic fluid from the main valve 24 to the coupler cylinder 21 is constantly open, and a work implement cylinder-side discharge port for feeding hydraulic fluid from the main valve 24 to the work implement cylinder 22 is open only when the work implement is being operated. The main valve 24 causes the load pressure of the work implement cylinder 22 to return to the volume control valve of the main pump 23 as a load sensing (LS) pressure. The main valve 24 applies a pump discharge pressure and the LS pressure to the volume control valve of the main pump 23. The inclination angle of the skew plate 23*a* of the main pump 23 is changed by the pump discharge pressure and the LS pressure returned from the main valve 24. The main pump 23 discharges the hydraulic fluid only at a flow rate requested by the main valve 24 for extending and contracting the work implement cylinder 22. The diameter of the coupler cylinder-side discharge port may be less than the diameter of the work implement cylinder-side discharge port.

The boosting valve 25 is connected to the main pump 23 and the main valve 24 via hydraulic piping. The boosting valve 25 is able to switch between a boosting position Q1 for raising the pressure of the hydraulic fluid supplied from the main pump 23 to the coupler cylinder 21, and a non-boosting position Q2 that does not change the pressure of the hydraulic fluid supplied from the main pump 23 to the coupler cylinder 21. The positions of the boosting valve 25 are switched by the changeover switch 28.

As illustrated in FIGS. 2 and 4, when the boosting valve 25 is positioned in the boosting position Q1, a portion of the hydraulic fluid supplied from the main pump 23 to the coupler cylinder 21 via the main valve 24 is returned to the main pump 23 via the boosting valve 25. Consequently, the inclination angle of the skew plate 23*a* of the main pump 23 increases, and the volume of the hydraulic fluid supplied from the main pump 23 to the coupler cylinder 21 increases. As a result, the pressure of the hydraulic fluid supplied from the main pump 23 to the coupler cylinder 21 rises.

However, as illustrated in FIG. 3, when the boosting valve 25 is positioned in the non-boosting position Q2, the hydraulic fluid supplied from the main pump 23 to the coupler cylinder 21 is not returned to the main pump 23 via the boosting valve 25. As a result, while the inclination angle of the skew plate 23*a* of the main pump 23 is not increased by the return from the boosting valve 25, the pressure of the hydraulic fluid supplied from the main pump 23 to the coupler cylinder 21 rises in accordance with the driving of the main pump 23.

The pressure reducing valve 26 is connected with the main valve 24 and the coupler changeover valve 27 via hydraulic piping. The pressure reducing valve 26 reduces the pressure to a predetermined level when the pressure of the hydraulic fluid supplied from the main pump 23 is greater than the predetermined value. Consequently, excessive pressure being supplied to the coupler cylinder 21 can be inhibited. The pressure reducing valve 26 does not adjust the pressure when the pressure of the hydraulic fluid supplied from the main pump 23 is equal to or less than the predetermined value.

The coupler changeover valve 27 is connected to the pressure reducing valve 26 and the coupler cylinder 21 via hydraulic piping. The coupler changeover valve 27 is able to switch between a lock-side position R1 for supplying hydraulic fluid from the main pump 23 to the coupler cylinder 21 so that the coupler cylinder 21 drives in the locking direction P1, and an unlock-side position R2 for supplying hydraulic fluid from the main pump 23 to the coupler cylinder 21 so that the coupler cylinder 21 drives in the unlocking direction P2. The positions of the coupler changeover valve 27 are switched by the changeover switch 28.

The changeover switch 28 is electrically connected to the boosting valve 25 and the coupler changeover valve 27. The changeover switch 28 is a switch that can be switched between three positions. For example, a rocker switch or the like may be used as the changeover switch 28, but the changeover switch 28 is not limited in this way.

The changeover switch 28 is able to switch between a lock position S1 when locking the bucket 6 to the quick coupler 7, a hold position S2 when holding the bucket 6 with the quick coupler 7, and an unlock position S3 when unlocking the bucket 6 from the quick coupler 7.

(Method for Attaching/Detaching Quick Coupler 7)

As illustrated in FIG. 2, when the changeover switch 28 switches to the lock position S1, the boosting valve 25 switches to the boosting position Q1 and the coupler changeover valve 27 switches to the lock-side position R1. As a result, a portion of the hydraulic fluid supplied from the main pump 23 to the coupler cylinder 21 via the main valve 24 is returned to the main pump 23 via the boosting valve 25 and the pressure of the main pump 23 rises. As a result, the bucket 6 is locked to the quick coupler 7 due to the supply of hydraulic fluid from the main pump 23 to the coupler cylinder 21 so as to drive the coupler cylinder 21 in the locking direction P1 (locking step).

As illustrated in FIG. 3, when the changeover switch 28 switches to the hold position S2, the boosting valve 25 switches to the non-boosting position Q2 and the coupler changeover valve 27 switches to the lock-side position R1. As a result, the hydraulic fluid is supplemented in the coupler cylinder 21 from the main pump 23 so as to drive the coupler cylinder 21 in the locking direction P1 in response to the driving of the main pump 23 (holding step). As a result, because the state of applying pressure to the coupler cylinder 21 can be maintained, the locked state of the bucket 6 to the quick coupler 7 can be stabilized over a long period of time. Although hydraulic fluid is constantly supplemented from the main pump 23 to the coupler cylinder 21 in the holding step because the main pump 23 is constantly driven, in particular, a sufficiently large pressure can be applied to the coupler cylinder 21 when the operating lever is operated for driving the work implement cylinder 22.

As illustrated in FIG. 4, when the changeover switch 28 switches to the unlock position S3, the boosting valve 25 switches to the boosting position Q1 and the coupler changeover valve 27 switches to the unlock-side position R2. As a result, a portion of the hydraulic fluid supplied from the main pump 23 to the coupler cylinder 21 via the main valve 24 is returned to the main pump 23 via the boosting valve 25 and the pressure of the main pump 23 rises. As a result, the bucket 6 is unlocked from the quick coupler 7 due to the supply of hydraulic fluid from the main pump 23 to the coupler cylinder 21 so as to drive the coupler cylinder 21 in the unlocking direction P2 (unlocking step).

(Characteristics)

In the quick coupler 20 according to the first embodiment, when the changeover switch 28 switches to the lock position S1 or the unlock position S3, a portion of the hydraulic fluid supplied from the main pump 23 to the coupler cylinder 21 via the main valve 24 is returned to the main pump 23 via the boosting valve 25. As a result, the pressure of the hydraulic fluid supplied from the main pump 23 to the coupler cylinder 21 can be raised quickly and therefore the coupler cylinder 21 can be driven quickly in the locking direction P1 or the unlocking direction P2. As a result, the bucket 6 can be quickly attached or detached.

In addition, when the changeover switch 28 switches from the lock position S1 to the hold position S2, hydraulic fluid is supplemented in the coupler cylinder 21 in response to the driving of the main pump 23. As a result, because the state of applying pressure to the coupler cylinder 21 can be maintained, the locked state of the bucket 6 can be stabilized over a long period of time.

In addition, when the bucket 6 is tilted after the changeover switch 28 is switched from the unlock position S3 to the hold position S2, the coupler cylinder 21 can be driven in the locking direction P1. As a result, the state of the bucket 6 can be set to the locked state due to the tilt operation of the bucket 6 without changing the changeover switch 28 to the lock position S1. In addition, the coupler cylinder 21 can be driven in the locking direction P1 even due to another operation of the work implement instead of the tilt operation of the bucket 6. Even in the above case, if the changeover switch 28 is in the hold position S2, the locked state of the bucket 6 can be stabilized over a long period of time as indicated above.

2. Second Embodiment

A quick coupler circuit 30 according to a second embodiment will be explained with reference to the drawings.

Figure 5:
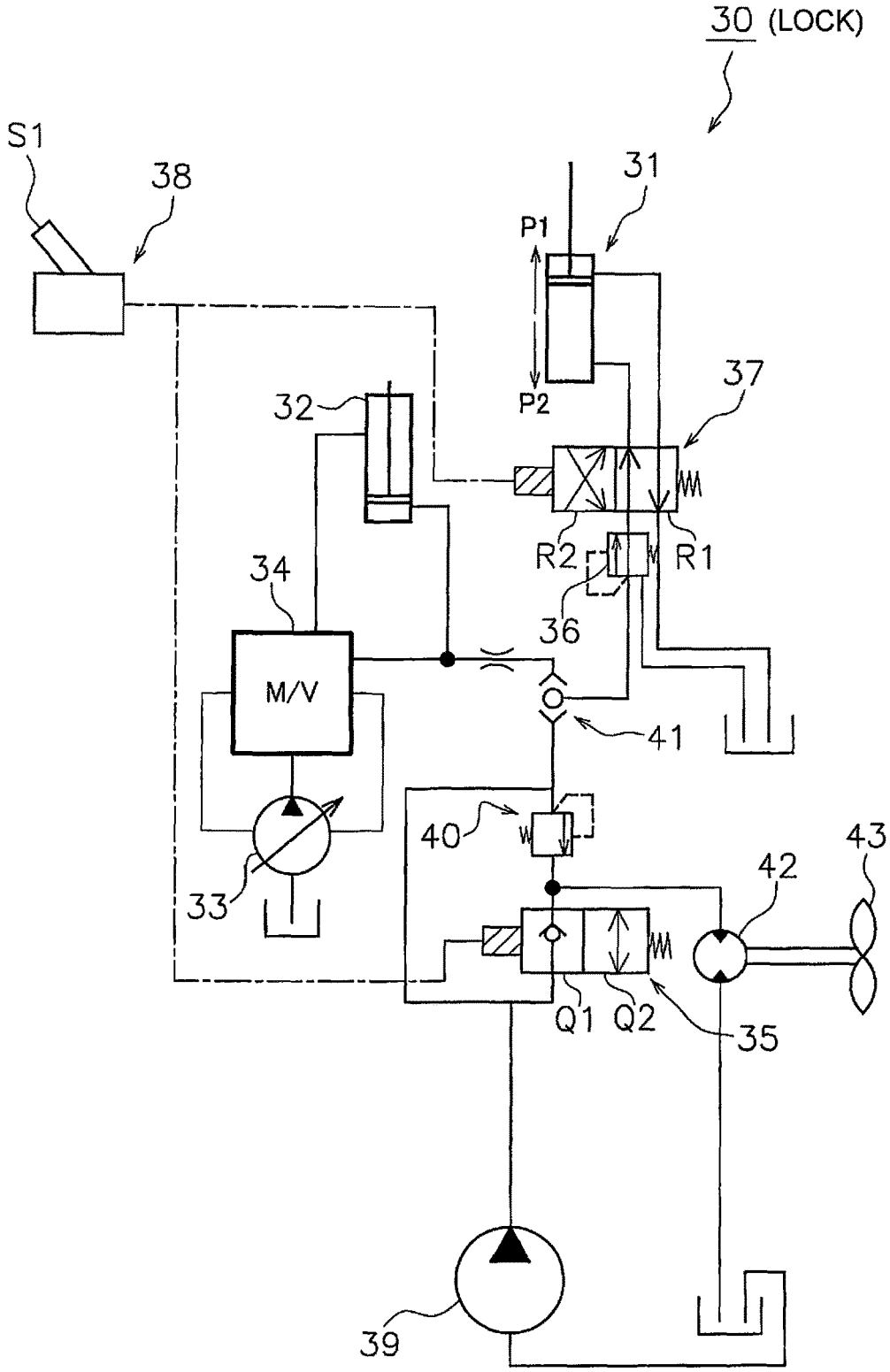
FIG. 5 is a schematic view of the quick coupler circuit (lock) according to a second embodiment.
Figure 6:
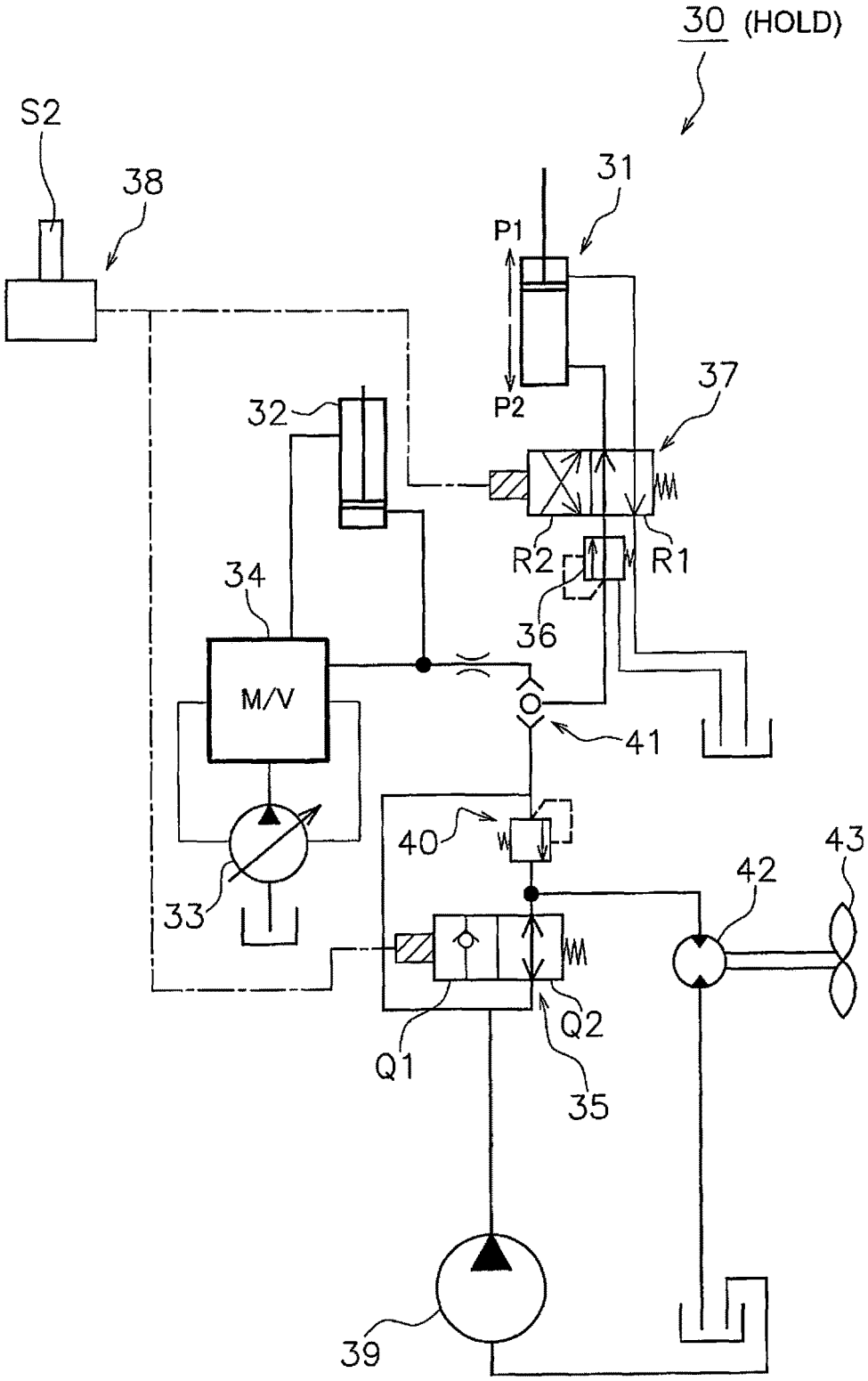
FIG. 6 is a schematic view of the quick coupler circuit (hold) according to the second embodiment.
Figure 7:
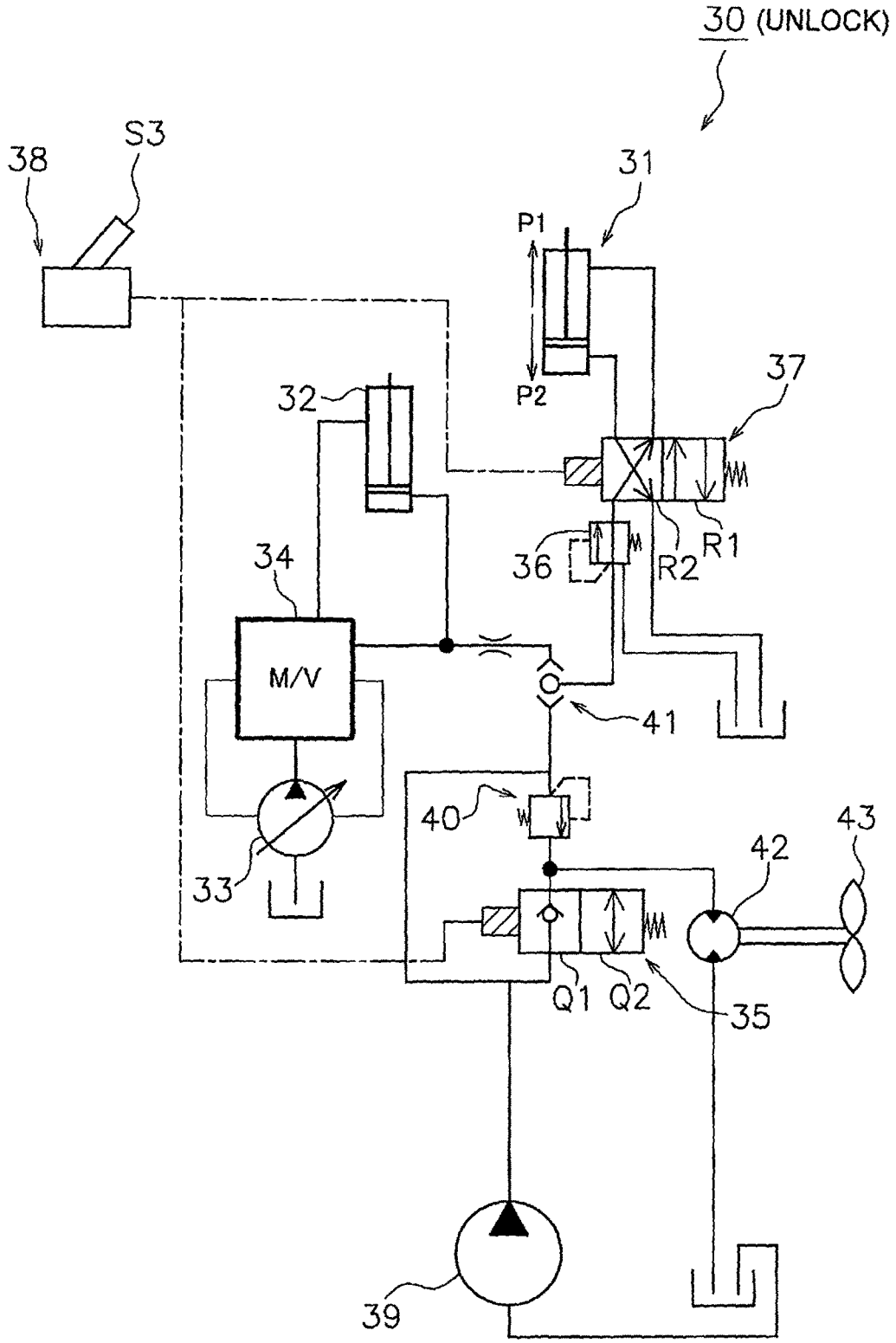
FIG. 7 is a schematic view of the quick coupler circuit (unlock) according to the second embodiment.

FIGS. 5-7 are schematic views of the quick coupler circuit 30 for attaching and detaching the bucket 6 to and from the quick coupler 7. FIG. 5 depicts a locking step for locking (securing) the bucket 6 to the quick coupler 7. FIG. 6 depicts a holding step for holding (retaining) the bucket 6 with the quick coupler 7. FIG. 7 depicts an unlocking step for unlocking (releasing) the bucket 6 from the quick coupler 7.

As illustrated in FIGS. 5-7, the quick coupler circuit 30 is provided with a coupler cylinder 31, a boosting valve 35, a pressure reducing valve 36, a coupler changeover valve 37, a changeover switch 38, a fan pump 39, a relief valve 40, a shuttle valve 41, a fan motor 42, and a fan 43.

The coupler cylinder 31, the boosting valve 35, the pressure reducing valve 36, the coupler changeover valve 37, and the changeover switch 38 respectively have the same configurations as the coupler cylinder 21, the boosting valve 25, the pressure reducing valve 26, the coupler changeover valve 27, and the changeover switch 28 as in the first embodiment.

The fan pump 39 is driven by the engine (not illustrated). The fan pump 39 is an example of a "first hydraulic pump" for supplying hydraulic fluid to the coupler cylinder 31 and to the fan motor 42. The coupler cylinder 31 and the fan motor 42 are connected in parallel with the fan pump 39. The fan pump 39 is a fixed displacement pump in the present embodiment.

The boosting valve 35 is connected to the fan pump 39 and the fan motor 42 via hydraulic piping. The boosting valve 35 can be switched between a boosting position Q1 for boosting the pressure of the hydraulic fluid supplied from the fan pump 39 to the fan motor 42, and a non-boosting position Q2 for not changing the pressure of the hydraulic fluid supplied from the fan pump 39 to the coupler cylinder 31. The positions of the boosting valve 35 are switched with the changeover switch 38.

As illustrated in FIGS. 5 and 7, when the boosting valve 35 is in the boosting position Q1, the hydraulic fluid supplied from the fan pump 39 to the fan motor 42 is interrupted by the boosting valve 35. As a result, the pressure of the hydraulic fluid supplied from the fan pump 39 to the coupler cylinder 31 rises.

As illustrated in FIG. 6 however, when the boosting valve 35 is in the non-boosting position Q2, the hydraulic fluid supplied from the fan pump 39 to the fan motor 42 is not interrupted by the boosting valve 35. As a result, the hydraulic fluid is supplied from the fan pump 39 to the fan motor 42 via the boosting valve 35 and a portion of the hydraulic fluid is supplied from the fan pump 39 to the coupler cylinder 31.

The relief valve 40 is connected to the boosting valve 35, the fan pump 39, the shuttle valve 41, and the fan motor 42 via hydraulic piping. Hydraulic fluid flows through the relief valve 40 on the fan motor 42 side only when a pressure of a predetermined value or more is applied from the shuttle valve 41 side.

As illustrated in FIGS. 5 and 7, when the boosting valve 35 is in the boosting position Q1, the hydraulic fluid supplied from the fan pump 39 to the fan motor 42 is interrupted by the boosting valve 35, and therefore is supplied to the coupler cylinder 31 via the shuttle valve 41. When the coupler cylinder 31 moves to the locking direction P1, a predetermined pressure or greater is applied from the shuttle valve 41 side to the relief valve 40 and the hydraulic fluid flows from the relief valve 40 to the fan motor 42 side.

However as illustrated in FIG. 6, when the boosting valve 35 is positioned in the non-boosting position Q2, the relief valve 40 blocks the hydraulic fluid flowing from the boosting valve 35 to the shuttle valve 41 side.

The shuttle valve 41 is disposed between the boosting valve 35 and the coupler changeover valve 37. The shuttle valve 41 is connected to the pressure reducing valve 36, the fan pump 39, the relief valve 40, and the main valve 34 via hydraulic piping.

The quick coupler circuit 30 according to the second embodiment is provided with a work implement cylinder 32, a main pump 33, and the main valve 34. The work implement cylinder 32, the main pump 33, and the main valve 34 are respectively configured in the same way as the work implement cylinder 22, the main pump 23, and the main valve 24 according to the first embodiment.

The shuttle valve 41 allows the hydraulic fluid having the highest pressure among the hydraulic fluid supplied from the fan pump 39 side and the hydraulic fluid supplied from the main pump 33 side, to pass through to the coupler changeover valve 37 side. For example, because the volume of the main pump 33 increases when an operating lever (not illustrated) is operated for driving the work implement cylinder 32, the pressure on the main pump 33 side may be higher than the pressure on the fan pump 39 side. In this case, the shuttle valve 41 interrupts the hydraulic fluid supplied from the fan pump 39 side and allows the hydraulic fluid supplied from the main pump 33 side to flow to the coupler changeover valve 37 side.

The fan motor 42 rotates and drives the fan 43 due to the supply of hydraulic fluid.

(Method for Attaching/Detaching Quick Coupler 7)

As illustrated in FIG. 5, when the changeover switch 38 switches to the lock position S1, the boosting valve 35 switches to the boosting position Q1 and the coupler changeover valve 37 switches to the lock-side position R1. Consequently, the hydraulic fluid supplied from the fan pump 39 to the coupler cylinder 31 is interrupted and the pressure of the hydraulic fluid supplied from the fan pump 39 to the coupler cylinder 31 rises. As a result, the bucket 6 is locked to the quick coupler 7 because the hydraulic fluid is supplied from the fan pump 39 to the coupler cylinder 31 so as to drive the coupler cylinder 31 in the locking direction P1 (locking step).

As illustrated in FIG. 6, when the changeover switch 38 switches to the hold position S2, the boosting valve 35 switches to the non-boosting position Q2 and the coupler changeover valve 37 switches to the lock-side position R1. As a result, a portion of the hydraulic fluid supplied from the fan pump 39 to the fan motor 42 is supplemented to the coupler cylinder 31 so as to drive the coupler cylinder 31 in the locking direction P1 (holding step). As a result, because the state of applying pressure to the coupler cylinder 31 can be maintained, the locked state of the bucket 6 to the quick coupler 7 can be stabilized over a long period of time.

As illustrated in FIG. 7, when the changeover switch 38 switches to the unlock position S3, the boosting valve 35 switches to the boosting position Q1 and the coupler changeover valve 37 switches to the unlock-side position R2. As a result, the hydraulic fluid supplied from the fan pump 39 to the coupler cylinder 31 is interrupted and the pressure of the hydraulic fluid supplied from the fan pump 39 to the coupler cylinder 31 rises. As a result, the bucket 6 is unlocked from the quick coupler 7 due to the supply of hydraulic fluid from the fan pump 39 to the coupler cylinder 31 so as to drive the coupler cylinder 31 in the unlocking direction P2 (unlocking step).

(Characteristics)

In the quick coupler 30 according to the second embodiment, when the changeover switch 38 switches to the lock position S1 or the unlock position S3, the hydraulic fluid supplied from the fan pump 39 to the fan motor 42 is interrupted by the boosting valve 35. As a result, the pressure of the hydraulic fluid supplied from the fan pump 39 to the coupler cylinder 31 can be raised quickly and therefore the coupler cylinder 31 can be driven quickly in the locking direction P1 or the unlocking direction P2. As a result, the bucket 6 can be quickly attached or detached.

In addition, when the changeover switch 38 switches from the lock position S1 to the hold position S2, a portion of the hydraulic fluid supplied from the fan pump 39 to the fan motor 42 is supplemented in the coupler cylinder 31. As a result, because the state of applying pressure to the coupler cylinder 31 can be maintained, the locked state of the bucket 6 can be stabilized over a long period of time.

Other Embodiments

The present invention is not limited to the above embodiments and various changes and modifications may be made without departing from the spirit of the invention.

While the quick coupler circuit and the quick coupler attachment/detachment method according to the present invention are applicable to a wheel loader in the first and second embodiments, the present invention is not limited in this way. The quick coupler circuit and the quick coupler attachment/detachment method according to the present invention may be applicable to a work vehicle such as a motor grader, a hydraulic excavator, or the like.

While a bucket is listed as an example of the attachment in the first and second embodiments, the present invention is not limited in this way. A type of attachment other than a bucket, such as a cutter, a breaker, a fork, or the like, may be used.

While the changeover switch 28 is connected directly to the boosting valve 25 and the coupler changeover valve 27 in the first embodiment, the present invention is not limited in this way. For example, the changeover switch 28 may be connected to a control device and the control device may control the boosting valve 25 and the coupler changeover valve 27. Similarly, while the changeover switch 38 is connected directly to the boosting valve 35 and the coupler changeover valve 37 in the second embodiment, a control device may be interposed therein.

While the quick coupler circuit 20 is provided with the pressure reducing valve 26 in the first embodiment, the pressure reducing valve 26 may not be provided when the pressure resistance of the coupler cylinder 21 is high. Similarly, while the quick coupler circuit 30 is provided with the pressure reducing valve 36 in the second embodiment, the pressure reducing valve 36 may not be provided when the pressure resistance of the coupler cylinder 31 is high.

While the quick coupler circuit 30 is provided with the shuttle valve 41 in the second embodiment, the shuttle valve 41 may not be provided. When the quick coupler circuit 30 is not provided with the shuttle valve 41, only the hydraulic fluid supplied from the fan pump 39 is supplied to the coupler cylinder 31.

While a fan pump that is a fixed displacement pump is exemplified as the "first hydraulic pump" in the second embodiment, the present invention is not limited in this way. A steering pump for supplying hydraulic fluid to a steering cylinder or a braking pump for supplying hydraulic fluid to a braking cylinder, or the like can be used for the fixed displacement pump as the "first hydraulic pump."

What is claimed is:

1. A quick coupler circuit for attaching an attachment to a quick coupler and detaching the attachment from the quick coupler, the quick coupler circuit comprising:

a coupler cylinder configured to be driven due to a supply of hydraulic fluid, the coupler cylinder being driven in a locking direction to lock the attachment to the quick coupler and in an unlocking direction to unlock the attachment from the quick coupler;

an actuator configured to be driven due to the supply of hydraulic fluid, the actuator being a work implement cylinder configured to drive a work implement;

a hydraulic pump configured to be connected in parallel with the coupler cylinder and the actuator, and the hydraulic pump being configured to supply the hydraulic fluid to the coupler cylinder and the actuator, the hydraulic pump being a variable displacement pump;

a boosting valve configured to switch between a boosting position to raise a pressure of the hydraulic fluid supplied from the hydraulic pump to the coupler cylinder, and a non-boosting position to not change the pressure of the hydraulic fluid supplied from the hydraulic pump to the coupler cylinder;

a coupler changeover valve configured to switch between a lock-side position to supply hydraulic fluid from the hydraulic pump to the coupler cylinder so as to drive the coupler cylinder in the locking direction, and an unlock-side position to supply the hydraulic fluid from the hydraulic pump to the coupler cylinder so as to drive the coupler cylinder in the unlocking direction; and a changeover switch configured to switch between an unlock position, a lock position, and a hold position, wherein when the changeover switch switches to the lock position, the boosting valve switches to the boosting position and the coupler changeover valve switches to the lock-side position, when the changeover switch switches to the hold position, the boosting valve switches to the non-boosting position, the coupler changeover valve switches to the lock-side position, and the hydraulic fluid is supplied from the hydraulic pump to the coupler cylinder in response to driving of the hydraulic pump, and when the changeover switch switches to the unlock position, the boosting valve switches to the boosting position and the coupler changeover valve switches to the unlock-side position, and when the changeover switch switches to the unlock position or the lock position, a portion of the hydraulic fluid supplied from the hydraulic pump to the coupler cylinder is returned to the hydraulic pump via the boosting valve, thereby causing the pressure of the hydraulic fluid supplied from the hydraulic pump to the coupler cylinder to rise.

2. A quick coupler circuit for attaching an attachment to a quick coupler and detaching the attachment from the quick coupler, the quick coupler circuit comprising:

a coupler cylinder configured to be driven due to a supply of hydraulic fluid, the coupler cylinder being driven in a locking direction to lock the attachment to the quick coupler and in an unlocking direction to unlock the attachment from the quick coupler;

an actuator configured to be driven due to the supply of hydraulic fluid;

a first hydraulic pump configured to be connected in parallel with the coupler cylinder and the actuator, and the first hydraulic pump being configured to supply the hydraulic fluid to the coupler cylinder and the actuator, the first hydraulic pump being a fixed displacement pump;

a boosting valve configured to switch between a boosting position to raise a pressure of the hydraulic fluid supplied from the first hydraulic pump to the coupler cylinder, and a non-boosting position to not change the pressure of the hydraulic fluid supplied from the first hydraulic pump to the coupler cylinder;

a coupler changeover valve configured to switch between a lock-side position to supply hydraulic fluid from the first hydraulic pump to the coupler cylinder so as to drive the coupler cylinder in the locking direction, and an unlock-side position to supply the hydraulic fluid from the first hydraulic pump to the coupler cylinder so as to drive the coupler cylinder in the unlocking direction; and a changeover switch configured to switch between an unlock position, a lock position, and a hold position, the unlock position, the lock position, and the hold position being three discrete physical positions, wherein when the changeover switch switches to the lock position, the boosting valve switches to the boosting position and the coupler changeover valve switches to the lock-side position, when the changeover switch switches to the hold position, the boosting valve switches to the non-boosting position, the coupler changeover valve switches to the lock-side position, and a portion of the hydraulic fluid supplied from the first hydraulic pump to the actuator is supplied to the coupler cylinder, when the changeover switch switches to the unlock position, the boosting valve switching to the boosting position and the coupler changeover valve switching to the unlock-side position, and when the changeover switch switches to the unlock position or the lock position, the hydraulic fluid supplied from the first hydraulic pump to the actuator is interrupted by the boosting valve, thereby causing the pressure of the hydraulic fluid supplied from the first hydraulic pump to the coupler cylinder to rise.

3. The quick coupler circuit according to claim 2, further comprising:

a second hydraulic pump configured to supply hydraulic fluid to a work implement; and a shuttle valve disposed between the coupler changeover valve and the boosting valve, and the shuttle valve being connected to the second hydraulic pump, the shuttle valve being configured to allow hydraulic fluid having a highest pressure among the hydraulic fluid supplied from the first hydraulic pump and the hydraulic fluid supplied from the second hydraulic pump, to pass through to a coupler changeover valve side.

4. A quick coupler attachment/detachment method for attaching an attachment to a quick coupler and detaching the attachment from the quick coupler, the method comprising:

locking the attachment to the quick coupler;

holding the attachment to the quick coupler;

unlocking the attachment from the quick coupler; and operating a changeover switch between a lock position, a hold position, and an unlock position when executing the locking of the attachment, the holding of the attachment, and the unlocking of the attachment, respectively, wherein when locking, hydraulic fluid is supplied from a hydraulic pump to a coupler cylinder so that the coupler cylinder is driven in a locking direction to lock the quick coupler to the attachment, a portion of the hydraulic fluid being returned to the hydraulic pump via a boosting valve in response to the changeover switch being in the lock position, thereby causing the pressure of the hydraulic fluid supplied from the hydraulic pump to the coupler cylinder to rise;

when holding, the hydraulic fluid is supplied from the hydraulic pump to the coupler cylinder in response to the driving of the hydraulic pump so that the coupler cylinder is driven in the locking direction, a portion of the hydraulic fluid not being returned to the hydraulic pump via the boosting valve in response to the changeover switch being in the hold position; and when unlocking, the hydraulic fluid is supplied from the hydraulic pump to the coupler cylinder so that the coupler cylinder is driven in an unlocking direction to unlock the attachment from the quick coupler, a portion of the hydraulic fluid being returned to the hydraulic pump via the boosting valve in response to the changeover switch being in the unlock position, thereby causing the pressure of the hydraulic fluid supplied from the hydraulic pump to the coupler cylinder to rise.

* * * * *